US007074162B2

(12) United States Patent
Kuo

(10) Patent No.: US 7,074,162 B2
(45) Date of Patent: Jul. 11, 2006

(54) EXERCISE DEVICE

(75) Inventor: Parkson Kuo, Taipei (TW)

(73) Assignee: Via Technologies, Inc., Taipei (TW)

( * ) Notice: Subject to any disclaimer, the term of this patent is extended or adjusted under 35 U.S.C. 154(b) by 379 days.

(21) Appl. No.: 10/644,878

(22) Filed: Aug. 21, 2003

(65) Prior Publication Data

US 2004/0038780 A1 Feb. 26, 2004

(30) Foreign Application Priority Data

Aug. 21, 2002 (TW) ..... 91213030 U

(51) Int. Cl.
*A63B 22/00* (2006.01)

(52) U.S. Cl. ..... 482/54; 482/51; 482/52; 482/53

(58) Field of Classification Search ..... 482/53, 482/51, 52, 54
See application file for complete search history.

(56) References Cited

U.S. PATENT DOCUMENTS 4,555,108 A * 11/1985 Monteiro ..... 482/53
5,690,582 A * 11/1997 Ulrich et al. ..... 482/4

* cited by examiner

*Primary Examiner*—Glenn E. Richman
(74) *Attorney, Agent, or Firm*—Rabin & Berdo, PC

(57) ABSTRACT

An exercise device. The exercise device includes a wheel type treadmill, a roller shaft, a sensor, a panel, a processing unit, and a display. The wheel type treadmill has a plurality of footplates disposed on a wheel. The roller shaft is coupled to the wheel. The sensor is disposed on the treadmill, connecting with the roller shaft. The panel is coupled to the treadmill for setting operation modes. The processing unit is disposed in the panel to receive signals from the sensor and control the operation modes. The display is coupled to the panel, receiving video information from the processing unit and displaying environmental simulation. The device provides a more varied exercise experience.

18 Claims, 5 Drawing Sheets

EXERCISE DEVICE

BACKGROUND OF THE INVENTION

1. Field of the Invention

The present invention relates to an exercise device, and in particular to an exercise device comprising a wheel type treadmill and a display or other simulation apparatus to provide a wide variety of interactive exercise options.

2. Description of the Related Art

Exercise devices of various types are well known and popular. However, exercise is often repetitive and boring, especially when performed indoors. One widely used exercise device is a treadmill, comprising a belt 13' driven by roller shafts 15*a*', 15*b*', as shown in FIG. 1. Settings such as speed are input from a panel 100' and a handrail 11' is held during use. Front and back roller shafts 15*a*', 15*b*' either actively drive the belt 13' as the user 10' runs or walks thereon, or, in passive mode, freely rotate, driven by user tread activity producing friction on belt 13'.

Even so, the device provides only a very limited range of exercise experience, and thus, little motivation or interest to the user.

SUMMARY OF THE INVENTION

Thus, an object of the invention is to provide an exercise device, provided with a display or other simulation apparatus, offering the user a simulated environment for both mental and physical interactivity and providing climbing experience to make exercise routines fresh and motivating.

The present invention provides an exercise device, including a wheel type treadmill, a roller shaft, a sensor, a panel, a processing unit, and a display. The wheel type treadmill has a plurality of footplates disposed on a wheel. The roller shaft is coupled to the wheel. The sensor is disposed on the treadmill, connecting with the roller shaft. The panel is coupled to the treadmill for setting operation modes. The processing unit is disposed in the panel to receive signals from the sensor and control the operation modes. The display is coupled to the panel, receiving video information from the processing unit and displaying environmental simulation.

A detailed description is given in the following embodiments with reference to the accompanying drawings.

BRIEF DESCRIPTION OF THE DRAWINGS

The present invention can be more fully understood by reading the subsequent detailed description and examples with reference made to the accompanying drawings, wherein.

DETAILED DESCRIPTION OF THE INVENTION

Figure 1:
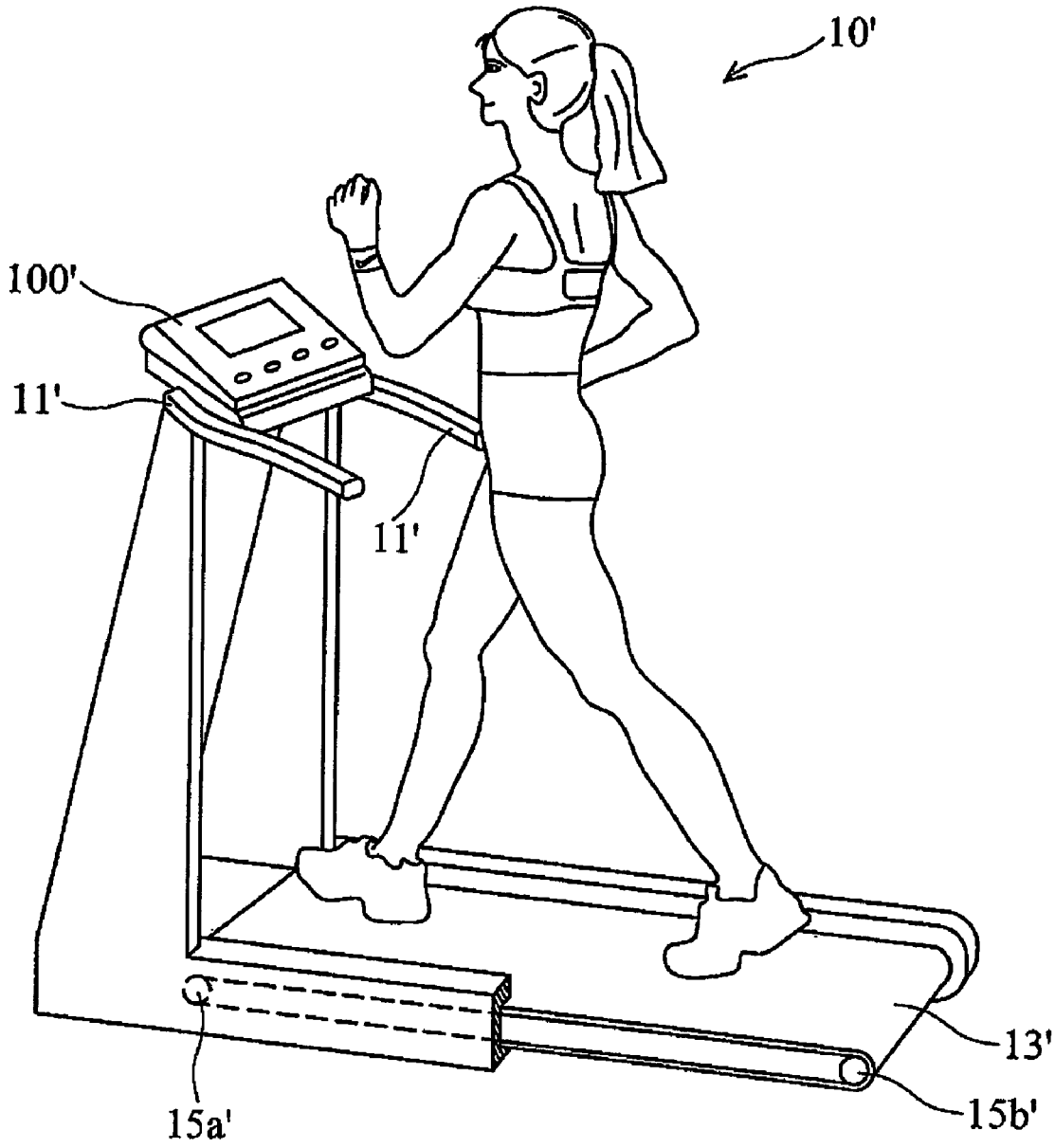
FIG. 1 (PRIOR ART)
FIG. 1 is a schematic view of a conventional treadmill.
Figure 2A:
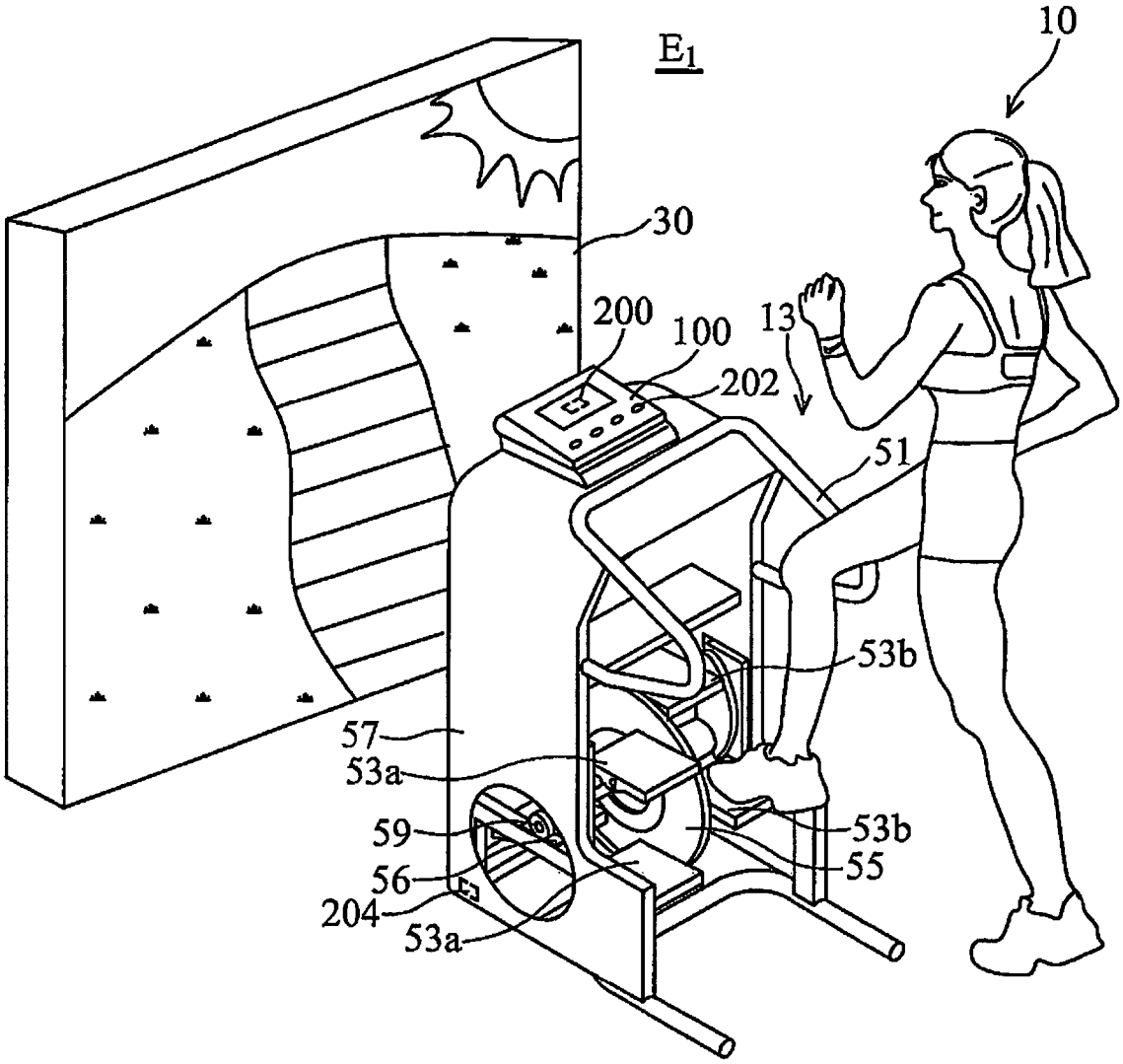
FIG. 2A is a schematic view showing an exercise device with a display according to the present invention.
Figure 3A:
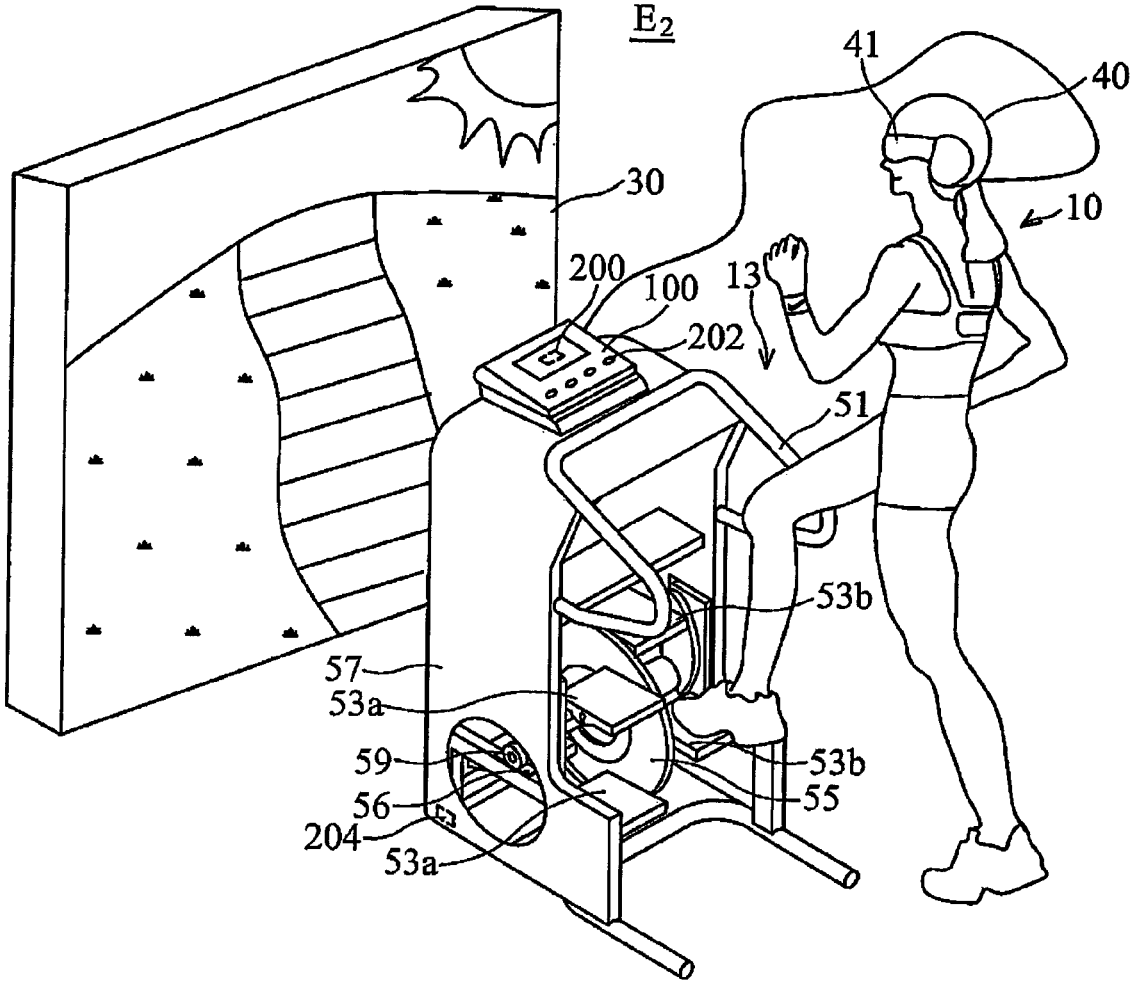
FIG. 3A is a schematic view showing an exercise device with a personal display device according to the present invention.

FIG. 2A is a schematic view of an exercise device $E_1$ with an upright wheel type treadmill 13 according to the present invention. The user holds the handrail 51 and steps on footplates 53*a* and 53*b*, disposed between two sides 57, to experience climbing motion. The left and right footplates 53*a*, 53*b* are coupled to rotatable wheel 55. The wheel 55 rotates about a shaft 59, disposed on the side 57. The shaft 59 is coupled with a sensor 56 converting activity to signals received by the processing unit 200 to control the display 30 or personal display device 40 (as shown in FIG. 3A) such that climbing, walking or running speed controls the displayed simulation. A panel 100 is disposed in front of the treadmill 13, providing different operation settings such as speed and active or passive mode selection. In passive mode, the user 10 can climb at any desired speed, controlling the speed of the treadmill 13. In passive mode, a predetermined speed is set, and followed by the user 10.

The footplates 53 of the treadmill 13 are kept in a useable horizontal orientation by built-in counter-weighting. Other means can be implemented to maintain the footplates in a horizontal orientation, as is apparent to those skilled in the art, thus, further explanation is not described here.

Figure 2B:
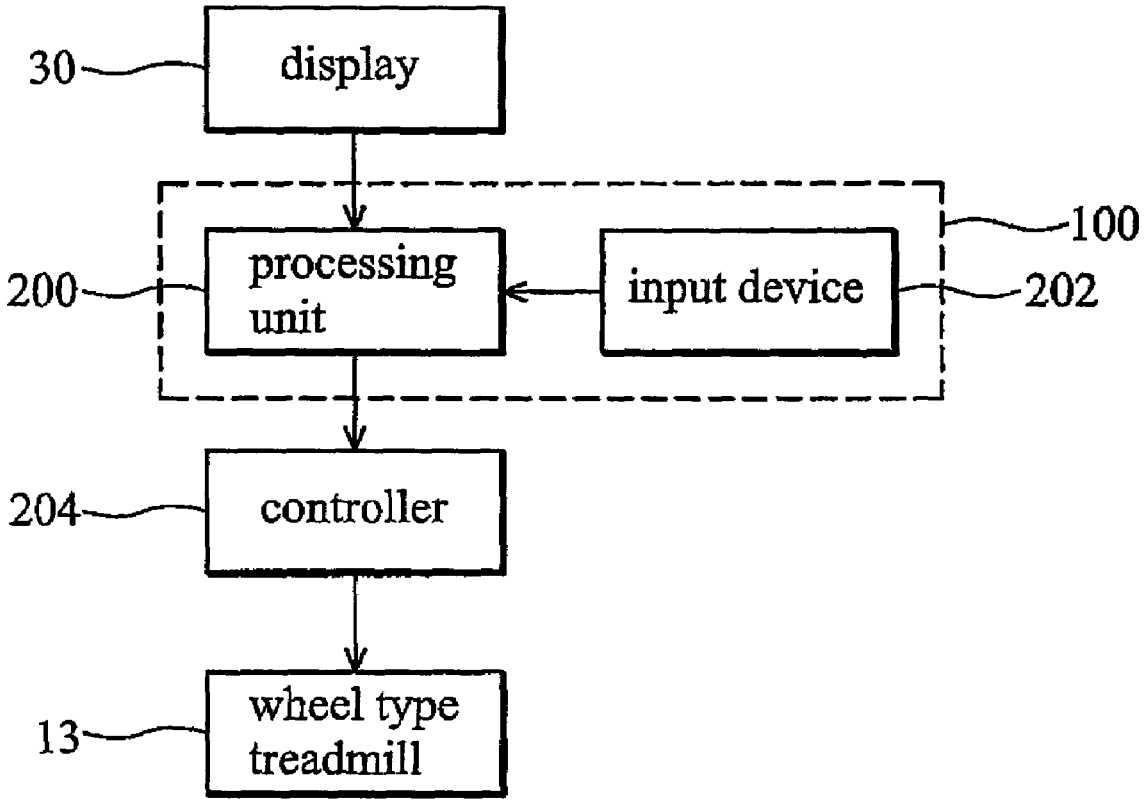
FIG. 2B is a flowchart showing steps for operating the exercise device with the display according to the first embodiment of the invention.

FIG. 2B is a flowchart showing steps for operating the exercise device with an environmental simulation display device 30. In this case, the environmental simulation display device 30 is a type of display unit to show simulated videos during use, and the environmental simulation display device 30 is coupled to the panel 100. The environmental simulation display device 30 can be a panel type, disposed in front of the treadmill 13. The panel 100 has a processing unit 200 and an input device 202. When the processing unit 200 receives a command from the input device 202, a signal is sent to a controller 204 located at the base of the treadmill 13. The controller 204 controls the treadmill 13. Thus, combining the treadmill 13 and the environmental simulation display device 30 provides a variety of exercising environments.

Furthermore, FIG. 3A is a schematic view showing an exercise device $E_2$ with a personal display device 40 according to the second embodiment. In this case, the personal display device 40 has a display unit 41 disposed thereon to provide environmental simulation.

Figure 3B:
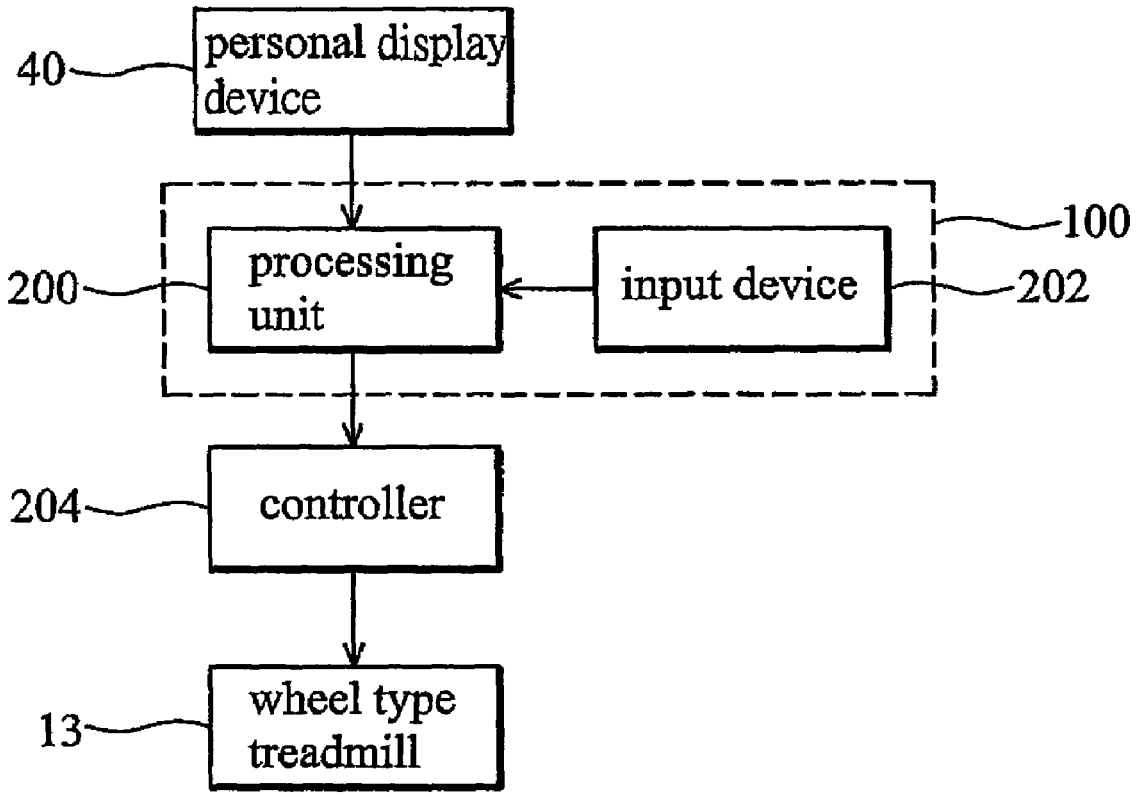
FIG. 3B is a flowchart showing steps for operating the exercise device with the personal display device according to the second embodiment of the invention.

FIG. 3B is a flowchart showing steps for operating the exercise device $E_2$ with the personal display device 40 according to the second embodiment of the invention. The panel 100 has a processing unit 200 and an input device 202. When the processing unit 200 receives a command from the input device 202, a signal is sent to a controller 204 located at the base of the treadmill 13. The controller 204 controls the treadmill 13. Thus, combining the treadmill 13 and the personal display device 40 offers the user 10 a simulated environment for both mental and physical interactivity and providing climbing experiences to make exercise routines fresh and motivating.

When the user 10 uses the treadmill 13 with the personal display device 40 thereon, the displayed simulation corresponds to the level of activity on the exercise device.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An exercise device, comprising:

a wheel type treadmill having a plurality of footplates disposed on a wheel;

a roller shaft, coupled to the wheel;

a panel, coupled to the wheel type treadmill for setting operation modes;

a display unit, coupled to the panel, receiving video information and displaying environmental simulation; and a counterweight device coupled to the footplates, keeping the footplates in a horizontal orientation.

2. The exercise device as claimed in claim 1, wherein the footplates are disposed on each side of the wheels, rotating with the roller shaft.

3. The exercise device as claimed in claim 1, further comprising a sensor, disposed on the wheel type treadmill and coupled to the roller shaft, detecting rotational speed of the roller shaft.

4. The exercise device as claimed in claim 1, further comprising an input device, coupled to the panel; and a processing unit disposed in the panel to control the operation modes according to rotational speed.

5. The exercise device as claimed in claim 4, further comprising a controller, coupled to the processing unit and the wheel type treadmill, wherein when the processing unit receives a command from the input device, a signal is sent to a controller to control the wheel type treadmill.

6. The exercise device as claimed in claim 1, further comprising a personal display device, with the display unit disposed therein, coupled to the panel.

7. An exercise device, comprising:

a wheel type treadmill, having footplates, disposed on a wheel;

a roller shaft, coupled to the wheel;

a panel, coupled to the treadmill, for setting operation modes;

an environmental simulation display device, coupled to the panel, receiving simulated information from the processing unit and displaying the same; and a counterweight device coupled to the footplates, keeping the footplates in a horizontal orientation.

8. The exercise device as claimed in claim 7, wherein the footplates are disposed on each side of the wheel, rotating with the roller shaft.

9. The exercise device as claimed in claim 7, further comprising a sensor, disposed on the wheel type treadmill and coupled to the roller shaft, detecting rotational speed of the roller shaft.

10. The exercise device as claimed in claim 7, further comprising an input device, coupled to the panel; and a processing unit, disposed in the panel to control the operation modes according to rotational speed.

11. The exercise device as claimed in claim 10, wherein further comprising a controller, coupled to the processing unit and the wheel type treadmill, wherein when the processing unit receives a command from the input device, a signal is sent to a controller to control the wheel type treadmill.

12. An exercise device, comprising:

a wheel type treadmill having a plurality of footplates disposed on a wheel;

a roller shaft, coupled to the wheel;

a panel, coupled to the wheel type treadmill for setting operation modes; and a counterweight device coupled to the footplates, keeping the footplates in a horizontal orientation.

13. The exercise device as claimed in claim 12, wherein the footplates are disposed on each side of the wheels, rotating with the roller shaft.

14. The exercise device as claimed in claim 12, further comprising a sensor, disposed on the wheel type treadmill and coupled to the roller shaft, detecting rotational speed of the roller shaft.

15. The exercise device as claimed in claim 12, further comprising an input device, coupled to the panel; and a processing unit, disposed in the panel to control the operation modes according to rotational speed.

16. The exercise device as claimed in claim 15, further comprising a controller, coupled to the processing unit and the wheel type treadmill, wherein when the processing unit receives a command from the input device, a signal is sent to a controller to control the wheel type treadmill.

17. The exercise device as claimed in claim 12, further comprising a personal display device, coupled to the panel.

18. The exercise device as claimed in claim 12, further comprise a display unit, coupled to the panel, receiving video information and displaying environmental simulation.

* * * * *